United States Patent [19]

Busch et al.

[11] Patent Number: 4,610,134

[45] Date of Patent: Sep. 9, 1986

[54] THREAD DRAW-OFF NOZZLE FOR AN OPEN-END ROTOR SPINNING MACHINE

[75] Inventors: Dieter Busch, Wegberg; Ulrich Sannig, Monchen-Gladbach, both of Fed. Rep. of Germany

[73] Assignee: W. Schlafhorst & Co., Monchen-Gladbach, Fed. Rep. of Germany

[21] Appl. No.: 679,812

[22] Filed: Dec. 10, 1984

[30] Foreign Application Priority Data

Dec. 10, 1983 [DE] Fed. Rep. of Germany ..... 3344741

[51] Int. Cl.[4] ..... D01H 1/135; D01H 13/04

[52] U.S. Cl. ..... 57/417

[58] Field of Search ..... 57/400, 404, 414, 416, 57/417, 352

[56] References Cited

U.S. PATENT DOCUMENTS

| | | | |
|---|---|---|---|
| 3,121,306 | 2/1964 | Cizek et al. | 57/417 |
| 3,789,597 | 2/1974 | Schon | 57/417 |
| 3,822,541 | 7/1974 | Croasdale et al. | 57/417 X |
| 4,068,456 | 1/1978 | Landwehrkamp | 57/417 |
| 4,073,126 | 2/1978 | Bouhon | 57/416 X |

*Primary Examiner*—Donald Watkins

*Attorney, Agent, or Firm*—Herbert L. Lerner; Laurence A. Greenberg

[57] ABSTRACT

A thread draw-off nozzle for an open-end rotor spinning machine includes a nozzle body, and an exchangeable thread inlet funnel connected to the nozzle body.

12 Claims, 8 Drawing Figures

THREAD DRAW-OFF NOZZLE FOR AN OPEN-END ROTOR SPINNING MACHINE

The invention relates to a draw-off nozzle for an open-end rotor spinning machine.

The thread draw-off nozzle of an open-end rotor spinning machine has a great influence upon the quality of the spun thread.

Heretofore, it has not been possible to construct thread draw-off nozzles with sufficient uniformity for the great number of individual spinning stations of a rotor spinning machine and to maintain them in a sufficiently uniform condition of wear, so that a very good spinning result would be achieved with respect to the uniformity of the threads produced at the individual spinning stations.

It is accordingly an object of the invention to provide all of the thread draw-off nozzles of an open-end rotor spinning machine with prerequisites for the same thread delivery properties, so that the spinning result in its entirety is improved.

With the foregoing and other objects in view, there is provided, in accordance with the invention, a thread draw-off nozzle for an open-end rotor spinning machine, comprising a nozzle body, and an exchangeable thread inlet funnel connected to the nozzle body. The thread inlet funnel is thus manufactured separately from the nozzle body, and can therefore be produced by mass production methods which ensure absolutely the same thread delivery conditions.

This is especially the case, in accordance with another feature of the invention, when the thread inlet funnel is constructed as a drawn sheetmetal member. Metal sheets or plates made by modern methods can be assumed to be homogenous, and the drawing die does not wear so rapidly that between the first sheet metal member and, for example, the two hundredth sheetmetal member produced, no measurable difference in shape is observable.

In accordance with a further feature of the invention, the thread inlet funnel has an outer rim formed with backwardly directed clamping elements for detachably connecting the thread inlet funnel to the nozzle body. The clamping elements are directed backwardly in order to prevent them from coming into contact with the thread In accordance with an added feature of the invention, the clamping elements are formed of a plurality of small feet.

Such feet have a given spring action, so that they are well suited for a plug connection.

In accordance with an additional feature of the invention, the nozzle body is formed with at least one recess for receiving therein the rim of the thread inlet funnel. The rim of the thread inlet funnel way have the aforementioned clamping elements, such as the small feet, for example.

In accordance with yet another feature of the invention, the one recess of the nozzle body is defined by a rim overlapping the clamping elements of the thread inlet funnel. In this case, the small feet or other clamping elements provide a spring loading towards the outside against the surrounding rim. Depending upon how far the rim overlaps the clamping elements, a snap-connection, which is secure to a greater or lesser extent, is formed.

In accordance with yet a further feature of the invention, the thread inlet funnel is formed of tempered sheet steel. It is not necessary, however, to stamp and form the parts of previously tempered or hardened steel sheets; it is better to perform the tempering or hardening operation after the forming operation. This results in better thread travel properties.

The durability of the device is increased, if the thread inlet funnel is ground, chromium-plated, and polished. The surface treatment serves to provide a more uniform spinning result over very long periods of use.

Because the thread end, which is formed in the thread collecting groove of the rotor, rotates at high velocity, the thread draw-off nozzle offers the possibility of applying an additional twist to the thread by a rolling action. This rolling action is enhanced, and the frequency of thread breaks is reduced if, in accordance with yet a further feature of the invention, the thread inlet funnel is either formed with raised portions or with depressions which are machined in the surface thereof. More specifically, it is yet an added feature of the invention that the depressions are perforations formed in the wall of the funnel.

In accordance with an alternative feature of the invention, the thread inlet funnel is formed with a bead or corrugation which is impressed or stamped therein. Such beads or corrugations are relatively easy to produce because no dislocation of material or chip removal is required.

For practical reasons it is advantageous to provide the draw-off nozzle according to the invention with a special configuration. For example, the nozzle body can be provided with an outer-threaded neck portion, and a flange portion carrying the thread inlet funnel. The outer thread permits removal of the thread draw-off nozzle for the purpose of exchanging or replacing the thread inlet funnel by removing it from the open end spinning machine, for example, from the housing cover of the rotor housing, and, after the thread inlet funnel has been exchanged, allows the device to be brought back exactly into the exact operating position it had previously been in. The flange portion thereby assumes the function of the head of a bolt.

To facilitate the insertion and the removal of the thread inlet funnel, the body of the nozzle is provided with assembly means and/or disassembly means, in accordance with other features of the invention. More specifically in accordance with another feature of the invention, a recess formed in the nozzle body surrounds the clamping elements of the thread inlet funnel and is formed with a chamfer for facilitating assembly of the thread inlet funnel and the nozzle body.

In accordance with a concomitant feature of the invention, the nozzle body has a flange portion formed with two opposing through-holes for facilitating disassembly of the thread inlet funnel and the nozzle body.

When the thread inlet funnel is inserted, its clamping elements slide along the chamfer, and then snap-in behind the rim or edge of the nozzle body which overlaps them. In a subsequent disassembly, the through-holes in the flange portion of the nozzle body are used to apply a pressing tool or die from the rear onto the thread inlet funnel, in order to snap the latter out of the clamped retaining condition thereof.

Other features which are considered as characteristic for the invention are set forth in the appended claims.

Although the invention is illustrated and described herein as embodied in a thread draw-off nozzle for an open-end rotor spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
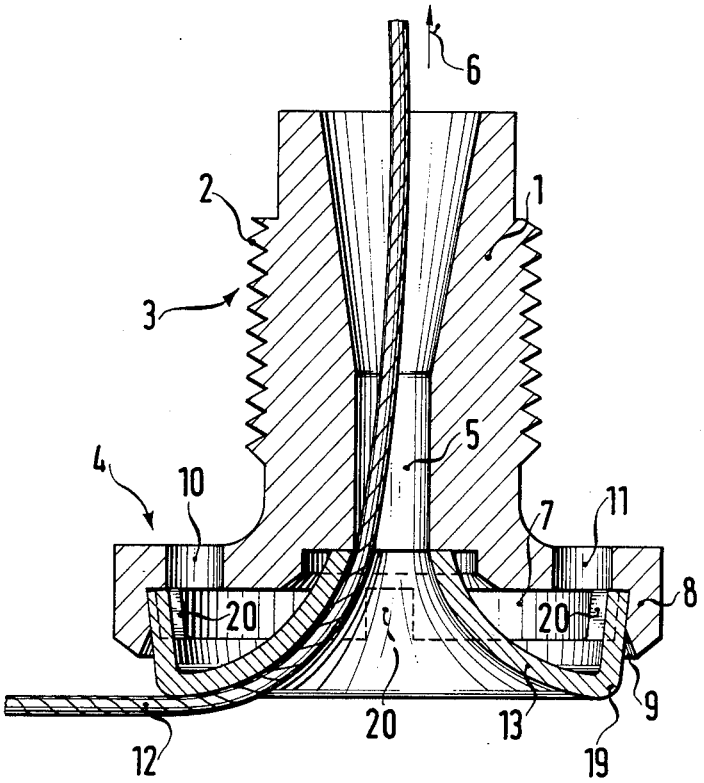
FIGS. 1 to 5 are longitudinal sectional views of five different embodiments of the thread draw-off nozzle according to the invention.

Referring now to the figures of the drawing, there are shown therein six embodiments of the thread draw-off nozzles according to the invention, all of which have the same nozzle body 1. The basic nozzle body 1 has a neck portion 3 formed with an outer thread 2, and a flange portion 4 which carries a thread inlet funnel 13 to 18. In the neck portion 3, a central bore 5 is provided which flares cone-like in the direction of the arrow 6 in which the thread is drawn off.

In the flange portion 4, the nozzle body 1 is formed with a recess 7 in which the rim or edge 19 of the thread inlet funnel is received, this recess 7 being defined by a rim or edge 8 which engages clamping elements 20 of the thread inlet funnel.

The nozzle body 1 is provided with auxiliary assembly means and auxiliary disassembly means for mounting or removing the inlet funnel. The assembly means are formed of a chamfer 9 at the rim 8, which engages the clamping elements 20 of the thread inlet funnel. The disassembly means are formed of two through-holes 10 and 11 which are disposed opposite one another in the flange portion 4.

In the first embodiment of the invention according to FIG. 1, the inlet for the thread 12 is formed by a thread-inlet funnel 13 which is exchangeably connected to the nozzle body 1. It is formed as a drawn sheetmetal part, and has an outer rim 19 which is provided with rearwardly directed clamping elements 20 for providing a detachable connection with the nozzle body 1. These clamping elements are formed of four similar small feet 20. These feet 20 are in this case evenly distributed around the periphery of the funnel 13. The rim 8 of the body 1 overlaps these clamping elements 20, and holds them securely.

The thread inlet funnel 13 is formed of hardened or tempered sheet steel. Furthermore, it is ground, chromium-plated and polished. This applies as well to the other embodiments of the thread inlet funnel which are described hereinafter.

The shape of the funnel, the type or construction of the clamping elements, and the properties of the material thereof are the same for all of the other embodiments of the thread inlet funnel as for the aforedescribed first embodiment which is by way of example.

Figure 2:
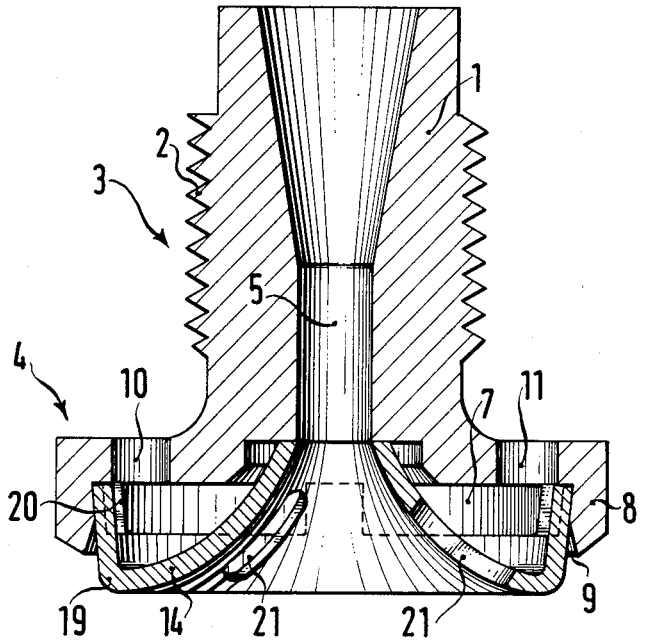

Deviating from the first embodiment, the thread inlet funnel 14 of the second embodiment according to FIG. 2 is formed with three depressions 21 in the form of elongated slot-like perforations of the funnel wall uniformly distributed around the circumference of the funnel.

Figure 3:
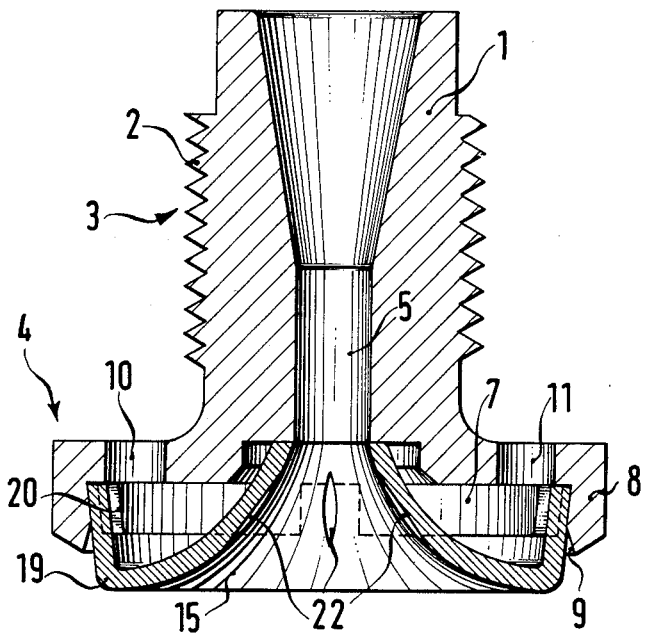

In contrast with this configuration of FIG. 2, the third embodiment of the invention according to FIG. 3 is provided with depressions in its thread inlet funnel 15 which are in the form of four notches 22 which are evenly distributed around the circumference of the funnel 15.

Figure 4:
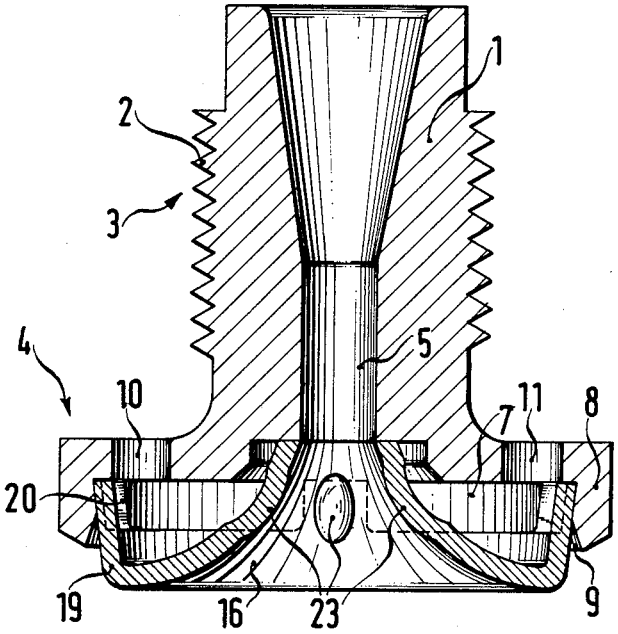

In contrast with the three preceding embodiments, the thread inlet funnel 16 of the fourth embodiment according to FIG. 4 has four raised portions in the form of beads or corrugations 23 which are uniformly distributed around the circumference thereof.

Figure 6:
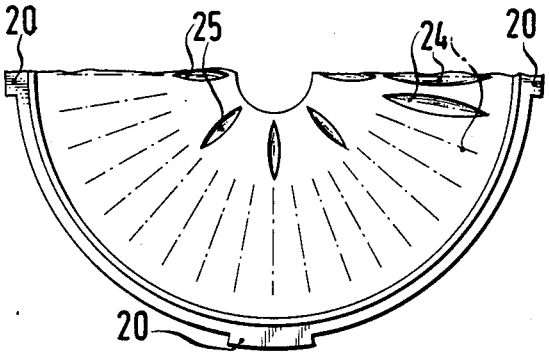
FIG. 6 is a fragmentary bottom plan view of FIG. 5 showing half of the nozzle.
Figure 5:
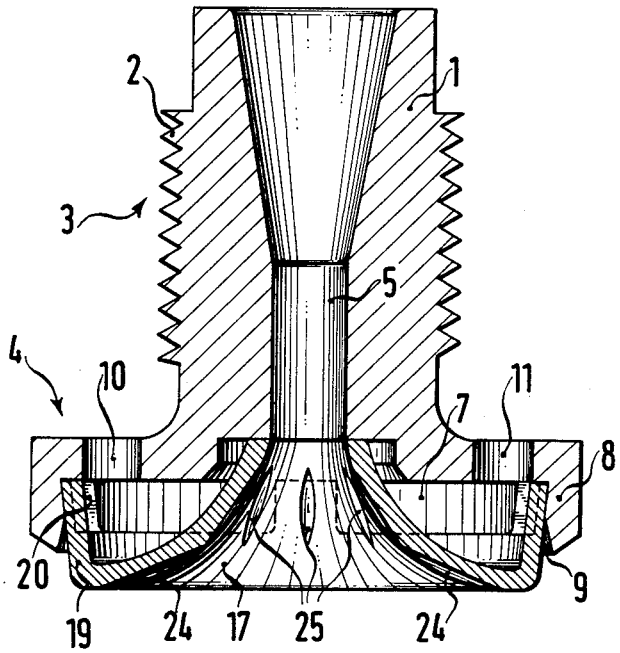

In the fifth embodiment according to FIGS. 5 and 6, the thread inlet funnel 17 is formed with circularly arranged depressions disposed in two rows above one another. Further to the outside is a plurality of notches 24, and further to the inside a plurality of notches 25.

Figure 8:
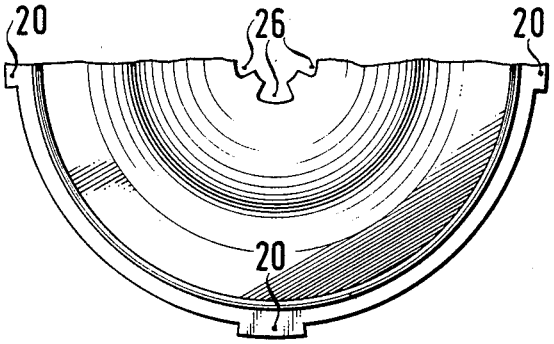
FIG. 8 is a fragmentary bottom plan view of FIG. 7 showing half of the nozzle.
Figure 7:
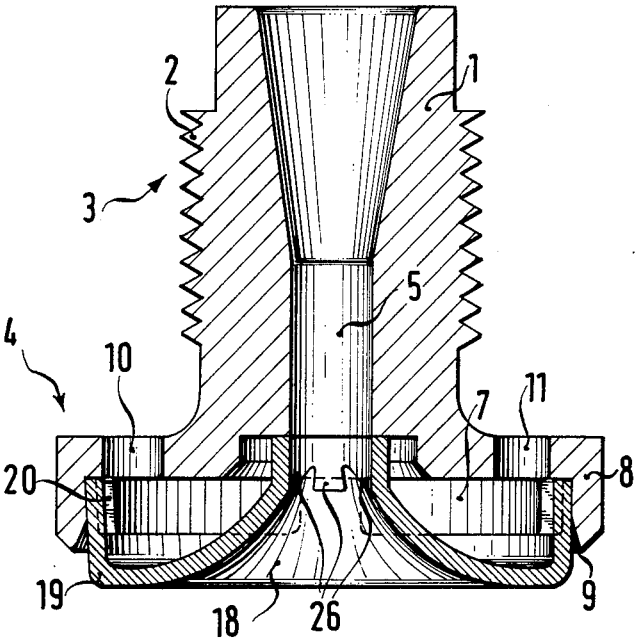
FIG. 7 is a longitudinal sectional view of a sixth embodiment of the thread draw-off nozzle.

At the last embodiment according to FIGS. 7 and 8, depressions also in the form of notches 26 are provided in the thread inlet funnel 18. These notches are located at the bottom of the funnel, and are arranged in the form of a star.

We claim:

1. Thread draw-off nozzle for an open-end rotor spinning machine, comprising a nozzle body, and an exchangeable thread inlet funnel connected to said nozzle body, said thread inlet funnel being constructed as a drawn sheet-metal member.

2. Thread draw-off nozzle for an open-end rotor spinning machine, comprising a nozzle body, and an exchangeable thread inlet funnel connected to said nozzle body, said thread inlet funnel having an outer rim formed with backwardly directed clamping elements for detachably connecting said thread inlet funnel to said nozzle body.

3. Thread draw-off nozzle according to claim 2, wherein said clamping elements are formed of a plurality of small feetlike projections clampingly engageable by said nozzle body.

4. Thread draw-off nozzle according to claim 2, wherein said nozzle body is formed with at least one recess for receiving therein said rim of said thread inlet funnel.

5. Thread draw-off nozzle according to claim 4, wherein said one recess of said nozzle body is defined by a rim overlapping said clamping elements of said thread inlet funnel.

6. Thread draw-off nozzle for an open-end rotor spinning machine, comprising a nozzle body, and an exchangeable thread inlet funnel connected to said nozzle body, said thread inlet funnel being formed of tempered sheet steel.

7. Thread draw-off nozzle according to claim 1, wherein said thread inlet funnel is formed with raised portions machined in the surface thereof.

8. Thread draw-off nozzle according to claim 1, wherein said thread inlet funnel is formed with depressions machined in the surface thereof.

9. Thread draw-off nozzle according to claim 8, wherein said funnel has a substantially conical wall, and said depressions are perforations formed in said funnel wall.

10. Thread draw-off nozzle according to claim 1, wherein said thread inlet funnel is formed with a bead impressed therein.

11. Thread draw-off nozzle according to claim 5, wherein said rim defining said recess formed in said nozzle body surrounds said clamping elements of said thread inlet funnel and is formed with a chamfer for facilitating assembly of said thread inlet funnel and said nozzle body.

12. Thread draw-off nozzle for an open-end rotor spinning machine, comprising a nozzle body, and an exchangeable thread inlet funnel connected to said nozzle body, said nozzle body having a flange portion formed with two opposing through-holes for facilitating disassembly of said thread inlet funnel and said nozzle body.

* * * * *